United States Patent [19]

Pritchard

[11] 4,240,564

[45] Dec. 23, 1980

[54] SOAP LEAF DISPENSER

[76] Inventor: William F. Pritchard, 220 Metcalf, Maxwell, Iowa 50161

[21] Appl. No.: 14,045

[22] Filed: Feb. 22, 1979

[51] Int. Cl.[3] ..... B65D 83/08

[52] U.S. Cl. ..... 221/213; 221/232; 221/251

[58] Field of Search ..... 221/232, 251, 213

[56] References Cited

U.S. PATENT DOCUMENTS

| | | | |
|---|---|---|---|
| 186,381 | 1/1877 | Strandgaard | 221/232 |
| 335,095 | 1/1886 | Stevenson | 221/232 X |
| 905,657 | 12/1908 | Coon | 221/232 |
| 1,236,514 | 8/1917 | Weekly | 221/232 |
| 1,302,624 | 5/1919 | Barton | 221/232 |
| 3,393,831 | 7/1968 | Stewart | 221/232 |

*Primary Examiner*—Allen N. Knowles
*Attorney, Agent, or Firm*—Zarley, McKee, Thomte, Voorhees & Sease

[57] ABSTRACT

A portable hand held soap leaf dispenser includes a housing adapted to support a stack of soap leaves therein. The housing has an opening adjacent one end through which soap leaves are individually dispensed. An ejector member is slidably supported in the housing for fore and aft movement between a forward ejecting position and a rearward retracted position. A biasing mechanism urges the ejector member and adjacent soap leaf into engagement whereby the adjacent soap leaf is dispensed through the opening in response to movement of the ejector member from the retracted position to the ejecting position therefor. The soap leaves may be supported on a platform biased toward the ejector member by the biasing mechanism. A plurality of wedges on the underside of the ejector member retentively engage a soap leaf in response to forward movement of the ejector member and freely slide over the soap leaves in response to rearward movement of the ejector member. A hold member depends from the housing top wall to retain the underlying soap leaves within the housing as a top soap leaf is ejected.

24 Claims, 5 Drawing Figures

SOAP LEAF DISPENSER

BACKGROUND OF THE INVENTION

This invention is related generally to dispensing apparatus for soap and more particularly to a portable hand held apparatus for dispensing soap leaves.

It has long been a problem to provide a reusable supply of soap which may be conveniently carried when traveling and the like. Conventional bars of soap become wet and slippery when used and therefore would have to be rewrapped after each use for storage with other toiletries. Plastic soap bar containers are available but these are quite bulky. Lodging establishments commonly provide miniature bars of soap in order to reduce waste but even the miniature bars provide substantially more soap than is needed for many uses such as washing one's hands. Machines are commercially available for dispensing soap in the form of powder, liquid and, more recently, leaves, but these are generally heavy apparatus adapted for permanent installation adjacent a sink or the like.

Accordingly, it is a primary object of the invention to provide an improved soap dispenser.

A further object of the invention is to provide a portable hand held soap leaf dispenser.

A further object is to provide a soap dispenser of compact size.

A further object is to provide a soap dispenser which dispenses only the amount of soap needed, thereby to prevent waste.

A further object is to provide a portable soap dispenser which is easily refillable.

Finally, a further object is to provide a portable hand held soap leaf dispenser which is economical to manufacture, refined in appearance and efficient in operation.

SUMMARY OF THE INVENTION

The soap leaf dispenser of the present invention includes a compact portable housing easily held in one's hand. The housing has a stack of soap leaves supported therein in engagement with an ejector member which is slidable back and forth between an ejecting position and a retracted position for sequentially dispensing individual soap leaves. The soap leaves are supported on a platform which is biased toward the ejector member so that each of the leaves is dispensed in a uniform manner whether the stack is full or substantially depleted. The ejector member has an externally accessible handle slidable within a longitudinal slot in the housing so that it can be easily advanced and retracted by a single thumb or finger movement. A hold spring positioned rearwardly of the ejector member pierces several top leaves so as to retain the underlying leaves in a stationary position when the top leaf is ejected. The housing includes top and bottom walls which are pivotally connected so that the housing may be fully opened for easily inserting a refill stack of soap leaves.

DESCRIPTION OF THE PREFERRED EMBODIMENTS

Figure 1:
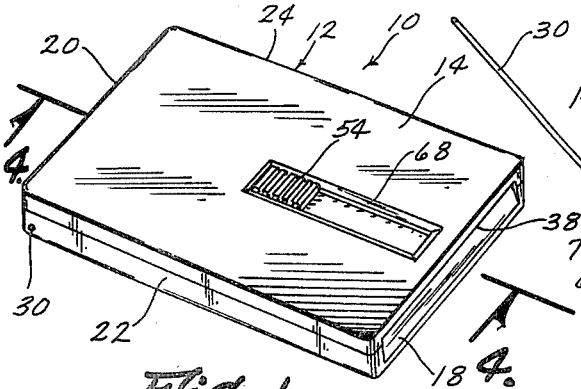
FIG. 1 is a perspective view of the soap leaf dispenser of the invention.
Figure 2:
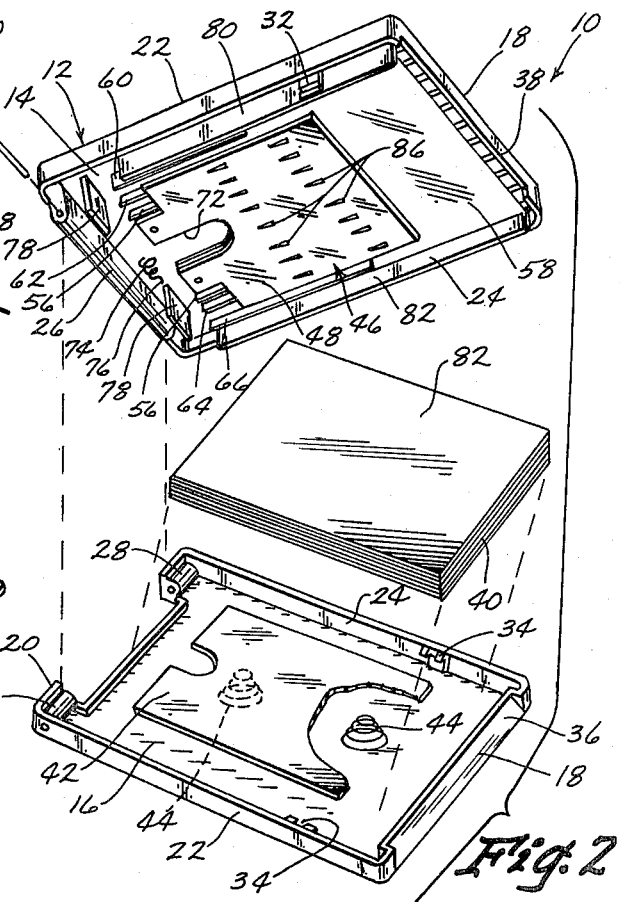
FIG. 2 is a blown up perspective view of the soap leaf dispenser.

The soap leaf dispenser 10 of the present invention is shown in FIGS. 1 and 2 as including a housing 12 having a top wall 14, a bottom wall 16, a forward end wall 18, a rearward end wall 20 and opposite sidewalls 22 and 24. The end walls and sidewalls are longitudinally split with the upper portion of each being formed as an integral part of top wall 14 and the lower portion of each being formed as an integral portion of bottom wall 16. The top and bottom walls 14 and 16 are provided with coacting hinge portions 26 and 28 respectively which are adapted to be aligned for receiving a hinge pin 30. Coacting snap fasteners 32 and 34 are engageable when the top wall is pivotally closed onto the bottom wall so as to releasably lock the housing in the closed condition shown in FIG. 1. The snap fasteners 32 and 34 are resilient members adapted to lock the housing closed during normal handling yet disengage in response to upward pressure on the front of the top wall to permit the housing to be opened for refilling. For this purpose, the lower portion of the forward end wall 18 is inwardly inclined as indicated at 36 so that the top and bottom portions may be gripped and separated. In addition, a tranverse opening 38 is formed at the juncture of the top and bottom portions of forward end wall 18 to provide for the dispensing of a soap leaf therethrough.

Figure 4:
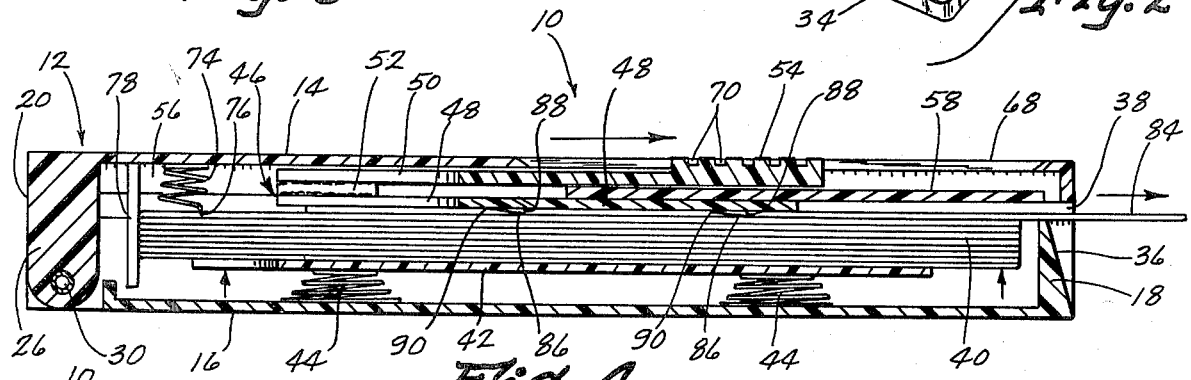
FIG. 4 is an enlarged side sectional view of the dispenser taken along line 4—4 in FIG. 1.

Referring to FIGS. 2 and 4, it is seen that a stack of soap leaves 40 is supported on a platform 42 which, in turn, is supported on springs 44. The springs 44 are preferably conical or coil-type springs formed of lignt gauge wire. The springs are preferably secured to the platform 42 and bottom wall 16 by adhesives or any other suitable means.

Figure 3:
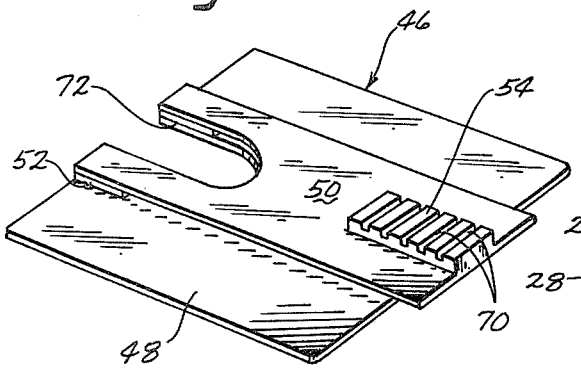
FIG. 3 is an enlarged detail perspective view of the ejector member.

An ejector member 46 is slidably supported on the underside of top wall 14. In FIG. 3, ejector member 46 is shown as including a plate 48, a slide member 50 and a spacer block 52, all of which are secured together by adhesive, rivets or any other suitable means so as to support the plate 48 and slide member 50 in closely spaced parallel relation. A finger grip handle 54 is formed on the upper surface of slide member 50 adjacent the forward end thereof.

To slidably support ejector member 46 on top wall 14, a slide track means is provided including a pair of transversely spaced-apart parallel guide flanges 56 adapted to laterally confine the slide member 50 for longitudinal sliding movement between them. A cross member or plate 58 is extended between and connected to the guide flanges 56 to form a pocket for slidably receiving slide member 50 between the cross member 58 and top wall 14. Additional guide flanges 60, 62, 64 and 66 are arranged laterally outwardly of guide flanges 56. The interior surfaces of the guide flanges 56 and 60–66 is arranged in the same plane as the interior surface of cross member 58 to provide a planar surface slidably engageable with plate 48 of ejector member 46.

With the ejector member 46 assembled onto top wall 14 as shown in FIG. 2, handle 54 is externally accessible through a longitudinal slot 68 in top wall 14 as shown in FIG. 1. Handle 54 is longitudinally slidable within the slot 68 and engageable with the forward end of the slot to define a forward ejecting position for ejector member 46, and engageable with the rearward end of the slot to define a rearward retracted position for ejector member 46. Transverse channels 70 may be formed in handle 54 to provide an improved gripping surface.

A U-shaped slot 72 is centrally formed at the rearward end of ejector member 46 to accommodate a hold member 74 which depends from top wall 14 for piercing several of the soap leaves supported on platform 42 when the housing is closed. Hold member 74 is shown in FIGS. 2 and 4 as including a lightweight compression spring having a depending pointed end portion 76.

In operation, the housing 12 is opened and a stack of soap leaves 40 is centrally positioned onto platform 42. When the housing is then closed, the soap leaves are maintained in uniformly stacked relation by depending rear flanges 78 and side flanges 80 and 82 on the interior side of top wall 14. Referring to FIG. 4, it can be seen that springs 44 bias the platform 42 and leaves 40 into engagement against the underside of plate 48 of ejector member 46. At the same time, the hold spring 74 pierces the top several soap leaves 40.

In order to dispense a soap leaf, handle 54 is engaged by one's thumb or finger and slid rearwardly to move the ejector member 46 to its retracted position. The handle 54 is then slid forwardly in slot 68 to move the ejector member 46 to its forward ejecting position whereby the top or adjacent soap leaf 84 is advanced through opening 38 in the housing forward end wall 18. The top soap leaf 84 is thus ejected from the housing and is available for use. Hold spring 74 pierces the underlying soap leaves 40 to maintain them in stationary relation as the top leaf 84 is ejected. Note that a thin slit is cut in the rearward end of the top soap leaf 84 by hold spring 74 as it is forwardly advanced by the ejector member 46. Since there is very little sliding friction between adjacent soap leaves, hold spring 74 does effectivley hold the underlying soap leaves in place.

In order for the ejector member 46 to retentively engage the top soap leaf 84 when being advanced and yet slide over the soap leaves when being retracted, the interior side of ejector member plate 48 is provided with a plurality of small wedges 86. Referring to FIG. 4, it is seen that the wedges 86 have a generally upright forward surface 88 and an inclined trailing surface 90 which tapers rearwardly and upwardly toward the surface of plate 48. The wedges 86 may have a triangular shape in cross section and have a depth no greater than the thickness of a soap leaf 40. Accordingly, the wedges 86 pierce the top soap leaf 84 as it is biased against the ejector member by the springs 44.

Figure 5:
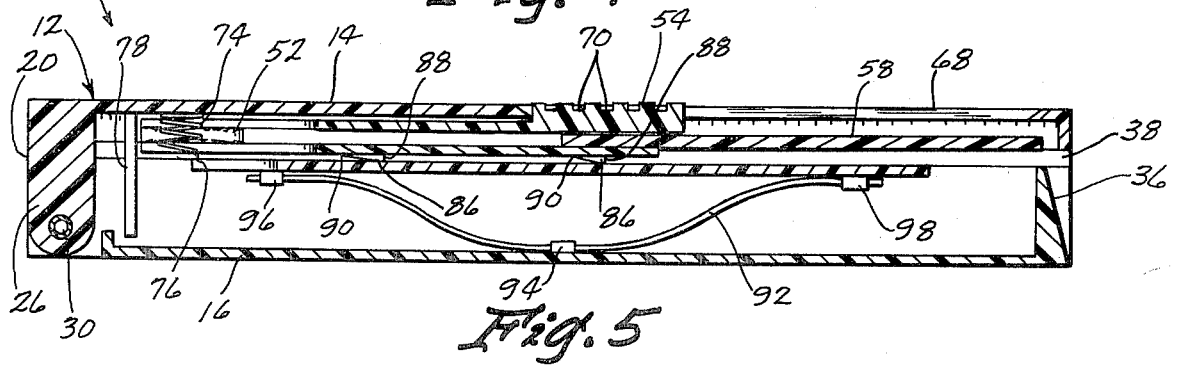
FIG. 5 is a side sectional view, similar to FIG. 4, of an alternate embodiment of the invention.

Referring to FIG. 5, an alternate embodiment of the invention is shown wherein a leaf spring 92 is substituted for the pair of coil-type springs 44 for supporting platform 42. Leaf spring 92 is fixed to bottom wall 16 at 94 and longitudinally slidably secured to the underside of platform 42 at 96 and 98.

The soap leaf dispenser 10 of the present invention is thus of compact size and of light weight so that it may be easily held in one's hand for dispensing a soap leaf whenever or whereever one is needed. The dispenser may be readily placed with other toiletries for travel since the stored soap leaves remain dry. This invention makes the known efficiencies of providing soap in leaf form available in a portable hand held dispenser. Thus there has been shown and described a soap leaf dispenser which accomplishes at least all of the stated objects.

I claim:

1. A soap leaf dispenser comprising a housing adapted to support a stack of soap leaves therein, said housing having a top wall, bottom wall and opposite forward and rearward ends with an opening adjacent the forward end for the dispensing of a soap leaf therethrough, an ejector member, means for supporting said ejector member in said housing for fore and aft sliding movement between a forward ejecting position and a rearward retracted position, means for sliding said ejector member between said ejecting and retracted positions, a hold member extending downwardly from said top wall and including an end portion adapted to pierce the rearward end of said soap leaves, and biasing means operatively associated with said ejector member for biasing a stack of soap leaves and said ejector member into engagement whereby the engaged soap leaf is dispensed through said opening in response to movement of the ejector member from the retracted position to the ejecting position therefor.

2. The soap leaf dispenser of claim 1 further comprising a soap leaf platform mounted in said housing and adapted to support a plurality of stacked soap leaves thereon.

3. The soap leaf dispenser of claim 2 wherein said biasing means includes a compression spring arranged between said platform and bottom wall.

4. The soap leaf dispenser of claim 3 wherein said compression spring comprises a coil-type spring.

5. The soap leaf dispenser of claim 3 wherein said compression spring comprises a leaf spring.

6. The soap leaf dispenser of claim 3 comprising a plurality of compression springs arranged between said platform and bottom wall.

7. The soap leaf dispenser of claim 3 further comprising means for securing said compression spring to said platform.

8. The soap leaf dispenser of claim 3 further comprising means for securing said compression spring to said bottom wall.

9. The soap leaf dispenser of claim 1 wherein said ejector member includes a plate adapted to engage said stack of soap leaves, a slide member and means for securing said plate and slide member together in generally parallel closely spaced relation, said top wall including a slide track means adapted to support said slide member for fore and aft movement thereon.

10. The soap leaf dispenser of claim 1 further comprising engagement means positioned on the interior side of said ejector member and adatped to retentively engage the adjacent soap leaf for forward movement therewith, said engagement means adapted to slide over the adjacent soap leaf in response to rearward movement of the ejector member.

11. The soap leaf dispenser of claim 10 wherein said engagement means comprises a wedge having a generally upright forward surface and an inclined trailing surface which tapers rearwardly from said forward surface.

12. The soap dispenser of claim 11 comprising a plurality of wedges on the interior side of said ejector member.

13. The soap dispenser of claim 12 wherein said wedge is generally triangular in cross section.

14. The soap leaf dispenser of claim 1 wherein said means for sliding said ejector member comprises a handle on said ejector member, said housing having an elongated slot adapted to slidably receive said handle.

15. The soap leaf dispenser of claim 14 wherein said elongated slot is located on the top wall of said housing.

16. The soap leaf dispenser of claim 1 wherein said hold member comprises a compression spring.

17. The soap leaf dispenser of claim 1 wherein said leaf dispensing opening is formed in said forward end wall.

18. The soap leaf dispenser of claim 1 wherein said top wall is supported for pivotal movement relative to said bottom wall between a normally closed position generally parallel to said bottom wall and an inclined open position whereby access is provided for inserting a stack of soap leaves into said housing.

19. The soap leaf dispenser of claim 1 further comprising upstanding rear and opposite side flanges in said housing which are adapted to confine said soap leaves in uniformly stacked relation therebetween.

20. A soap leaf dispenser comprising, a housing adapted to support a stack of soap leaves therein, said housing having a top wall, bottom wall and opposite forward and rearward ends with an opening adjacent the forward end for the dispensing of a soap leaf therethrough, an ejector member, means for supporting said ejector member in said housing for fore and aft sliding movement between a forward ejecting position and a rearward retracted position, means for sliding said ejector member between said ejecting and retracted positions, a hold member including an end portion adapted to pierce at least the second from the top soap leaf, and biasing means operatively associated with said ejector member for biasing a stack of soap leaves and said ejector member into engagement whereby the engaged soap leaf is dispensed through said opening in response to movement of the ejector member from the retracted position to the ejecting position therefor.

21. The structure of claim 20 wherein said end portion of said hold down member is operatively secured to said top wall and is adapted to extend through the top leaf and pierce at least the second from the top leaf whereby when said top leaf is dispensed a slit is formed in said top leaf only.

22. A leaf dispenser comprising, a housing adapted to support a stack of leaves therein, said housing having a top wall, bottom wall and opposite forward and rearward ends with an opening adjacent the forward end for the dispensing of a leaf therethrough, an ejector member, means for supporting said ejector member in said housing for fore and aft sliding movement between a forward ejecting position and a rearward retracted position, means for sliding said ejector member between said ejecting and retracted positions, a hold member operatively secured to said top wall and including an end portion adapted to extend through the top leaf and pierce at least the second from the top leaf whereby when said top leaf is dispensed a slit is formed in said top leaf only, biasing means operatively associated with said ejector member for biasing a stack of leaves and said ejector member into engagement whereby the engaged leaf is dispensed through said opening in response to movement of the ejector member from the retracted position to the ejecting position therefor.

23. A soap leaf dispenser comprising, a housing adapted to support a stack of soap leaves therein, said housing having a top wall, bottom wall and opposite forward and rearward ends with an opening adjacent the forward end for the dispensing of a soap leaf therethrough, an ejector member, means for supporting said ejector member in said housing for fore and aft sliding movement between a forward ejecting position and a rearward retracted position, means for sliding said ejector member between said ejecting and retracted positions, biasing means operatively associated with said ejector member for biasing a stack of soap leaves and said ejector member into engagement whereby the engaged soap leaf is dispensed through said opening in response to movement of the ejector member from the retracted position to the ejecting position therefor, said ejector member including a plate adapted to engage said stack of soap leaves, a slide member and means for securing said plate and slide member together in generally parallel closely spaced relation, and said top wall including a slide track means adapted to support said slide member for fore and aft movement thereon, said slide track means including a pair of guide flanges on the interior side of said top wall, said guide flanges adapted to laterally confine said slide member therebetween, and a cross member extending between and connected to said guide flanges, said cross member being received between said plate and slide member to slidably support said slide member between said cross member and top wall.

24. The soap leaf dispenser of claim 23 further comprising additional guide flanges arranged laterally outwardly of said aforementioned guide flanges and arragned to provide additional support for said plate.

* * * * *